US009990834B2

(12) United States Patent
Moore

(10) Patent No.: US 9,990,834 B2
(45) **Date of Patent: *Jun. 5, 2018**

(54) HYGIENE TRACKING COMPLIANCE

(71) Applicant: GOJO Industries, Inc., Akron, OH (US)

(72) Inventor: Mark Moore, Aurora, OH (US)

(73) Assignee: GOJO INDUSTRIES, INC., Akron, OH (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/530,284

(22) Filed: Dec. 19, 2016

(65) Prior Publication Data

US 2017/0365158 A1 Dec. 21, 2017

Related U.S. Application Data

(63) Continuation of application No. 14/643,053, filed on Mar. 10, 2015, now Pat. No. 9,524,632.

(Continued)

(51) Int. Cl.
*G08B 1/08* (2006.01)
*G08B 21/24* (2006.01)

(52) U.S. Cl.
CPC ..... *G08B 21/245* (2013.01)

(58) Field of Classification Search
CPC combination set(s) only.
See application file for complete search history.

(56) References Cited

U.S. PATENT DOCUMENTS 6,426,701 B1 * 7/2002 Levy ..... G08B 21/24 137/552.7

6,727,818 B1 * 4/2004 Wildman ..... G06F 19/3418 340/10.1

(Continued)

FOREIGN PATENT DOCUMENTS

CA 2941585 A1 9/2015
CN 102460525 A 5/2012

(Continued)

OTHER PUBLICATIONS

Canadian Office Action cited in Canadian Application No. 2,941,585 dated May 12, 2017, 5 pgs.

(Continued)

*Primary Examiner* — Travis Hunnings
(74) *Attorney, Agent, or Firm* — Cooper Legal Group, LLC

(57) ABSTRACT

One or more techniques and/or systems are provided for personal tracking of hygiene compliance of a user. For example, a mobile device may host a tracking component (e.g., a personal hygiene compliance app deployed on a cell phone or tablet). The tracking component may be configured to establish a communication connection, such as a Bluetooth communication connect, with a hygiene device (e.g., a soap dispenser). The tracking component may generate either a hygiene compliance metric or a non-hygiene compliance metric based upon whether a dispense event notification, indicating compliance by the user with a hygiene opportunity, is received from the hygiene device. In this way, the user may personally track hygiene compliance information based upon automated communication signals shared between the mobile device and the hygiene device.

20 Claims, 14 Drawing Sheets

Related U.S. Application Data

(60) Provisional application No. 61/950,375, filed on Mar. 10, 2014.

(56) References Cited

U.S. PATENT DOCUMENTS

| | | | | |
|---|---|---|---|---|
| 8,294,585 | B2 * | 10/2012 | Barnhill | G08B 21/245 134/56 R |
| 9,524,632 | B2 * | 12/2016 | Moore | G08B 21/245 |
| 2010/0121567 | A1 * | 5/2010 | Mendelson | G01C 21/206 701/467 |
| 2012/0112906 | A1 * | 5/2012 | Borke | G08B 21/245 340/539.13 |
| 2013/0122807 | A1 * | 5/2013 | Tenarvitz | H04B 5/0031 455/41.1 |

FOREIGN PATENT DOCUMENTS

| | | | |
|---|---|---|---|
| EP | 3117415 | A1 | 1/2017 |
| WO | 2015138386 | A1 | 9/2015 |

OTHER PUBLICATIONS

First Chinese Office Action cited in Chinese Application No. 201580013568.X dated Mar. 16, 2017, 13 pgs.
Corresponding Chinese Application: 201580013568.X; Second Chinese Office Action cited in Chinese Application No. 201580013568.X dated Sep. 25, 2017, 15 pages.

* cited by examiner

HYGIENE TRACKING COMPLIANCE

RELATED APPLICATION

This application claims priority to U.S. application Ser. No. 14/643,053, titled "HYGIENE TRACKING COMPLIANCE" and filed on Mar. 10, 2015, which claims priority to U.S. Provisional Application No. 61/950,375, titled "HYGIENE TRACKING COMPLIANCE" and filed on Mar. 10, 2014, both of which are incorporated herein by reference.

TECHNICAL FIELD

The instant application is generally directed towards systems and techniques for personal tracking of hygiene compliance. In particular, a mobile device communicates with hygiene devices, such as soap dispensers, to obtain hygiene compliance information that is provided to a user through a personalized hygiene compliance tracking interface hosted on the mobile device.

BACKGROUND

Many locations, such as hospitals, factories, restaurants, homes, etc., may implement various hygiene and/or disease control policies. For example, a hospital may set an 85% hygiene compliance standard for a surgery room. A hygiene opportunity may correspond to a situation or scenario where a person should perform a hygiene event, such as using a hand sanitizer or washing their hands. Compliance with the hygiene opportunity may increase a current hygiene level, while non-compliance may decrease the current hygiene level. In an example of monitoring hygiene, a hygiene dispenser may be monitored by measuring an amount of material, such as soap, lotion, sanitizer, etc., consumed or dispensed from the dispensing system. However, greater utilization of the hygiene dispenser may not directly correlate to improved hygiene (e.g., medical staff may inadvertently use the hygiene dispenser for relatively low transmission risk situations as opposed to relatively high transmission risk situations, such as after touching a high transmission risk patient in a surgery room).

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

Among other things, one or more systems and/or techniques for tracking hygiene compliance of a user are provided herein. In an example, a user may be associated with a mobile device (e.g., a nurse may carry a tablet, a mobile phone, or any other computing device while working at a hospital). The mobile device may host a personalized hygiene compliance tracking interface (e.g., an app deployed on the mobile device) through which the user may track personal hygiene compliance metrics and other hygiene related information (e.g., a map of hygiene devices within the hospital; compliance metrics of other hospital employees; etc.). When the mobile device comes within communication range of a hygiene device (e.g., a soap dispenser), the mobile device may receive a connection request from the hygiene device. In an example, the connection request may be received as one or more connectable advertising packets that are broadcast by the hygiene device utilizing a wireless protocol such as a Bluetooth protocol, a radio frequency signal, a Wi-Fi signal, a cellular signal, etc. In another example, the connection request may be broadcast from the mobile device to the hygiene device. In this way, the mobile device and the hygiene device may establish a communication connection based upon the connection request (e.g., a tracking component, hosted by the mobile device, may be configured to synchronize with the hygiene device over a Bluetooth connection).

In an example, a user zone entry notification may be received from the hygiene device. The user zone entry notification may indicate that the mobile device is located within a hygiene zone associated with the hygiene device (e.g., the soap dispenser may be located in a surgery room, and the hygiene zone may be defined as comprising at least a portion of the surgery room). If the user activates the hygiene device (e.g., the nurse dispenses soap from the soap dispenser to perform a hygiene event), then the hygiene device may broadcast (e.g., using the Bluetooth connection) a dispense event notification that may be received by the mobile device. A hygiene compliance metric may be generated for the user. The hygiene compliance metric and/or other information (e.g., a hygiene compliance ratio corresponding to a ratio of hygiene compliance to hygiene non-compliance of the user with resepct to hygiene opportunities) may be displayed through the personalized hygiene compliance tracking interface so that the user may personally track the user's hygiene compliance. If a dispense event notification is not received before expiration of a threshold time (e.g., 15 minutes) and/or a user zone exit notification is received (e.g., the nurse leaves the surgery room without using the soap dispenser), then a hygiene non-compliance metric may be generated. The hygiene non-compliance metric and/or other information may be displayed through the personalized hygiene compliance tracking interface. In this way, a user may track personal hygiene compliance in real time based upon automated information communicated between the mobile device and hygiene devices.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

DETAILED DESCRIPTION

Figure 1:
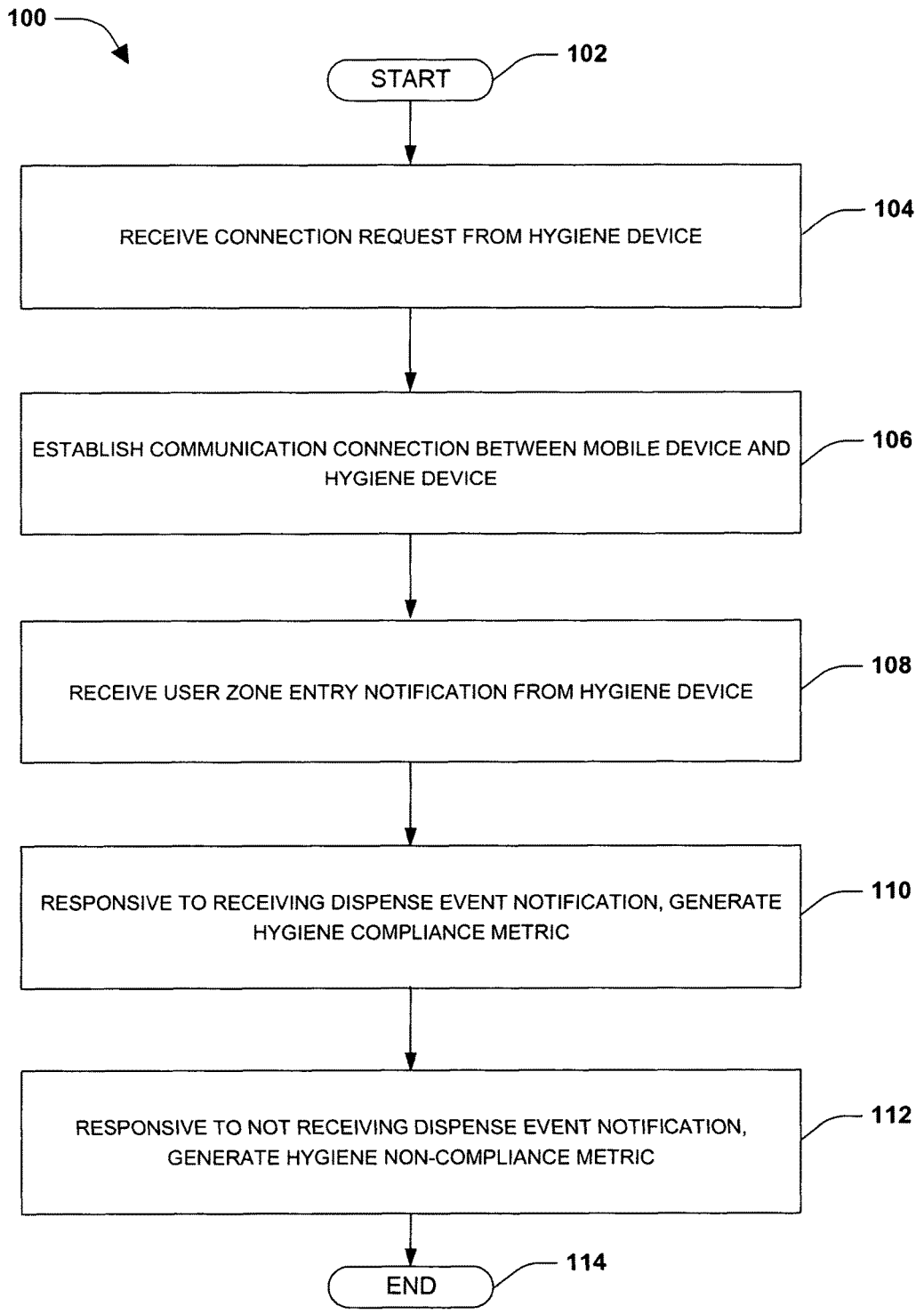
FIG. 1 is a flow diagram illustrating an exemplary method of tracking hygiene compliance of a user.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It may be evident, however, that the claimed subject matter may be practiced without these specific details. In other instances, structures and devices are illustrated in block diagram form in order to facilitate describing the claimed subject matter.

An embodiment of tracking hygiene compliance of a user is illustrated by an exemplary method 100 of FIG. 1. At 102, the method starts. At 104, a connection request is received from a hygiene device. For example, a doctor may have installed a personalized hygiene compliance tracking interface on a mobile device (e.g., deployment of an app on a cell phone or tablet). When the doctor comes within communication range of the hygiene device, such as a soap dispenser within a patient room, the mobile device may receive the connection request. In an example, the connection request is received as a wireless communication signal. For example, the hygiene device may be configured to broadcast the connection request as connectable adverting packets (e.g., adverts) using a Bluetooth or other wireless protocol (e.g., Wi-Fi, cellular communication, a radio frequency, etc.). In an example, a connectable adverting packet comprises about 20 bytes of connection request information, and may consume about 49 μA at about 3V. Connectable advertising packets may be broadcast over one or more channels, such as 3 channels having about 0.147 mW power consumption, about 120 bytes/second of connection request information, and about 3.14 WH power. In an example, a Bluetooth Core Specification (e.g., version 4) may be used to provide the ability to operate for years on coin-cell batteries, a relatively low cost, multi-vendor operability, enhanced range, and/or relatively low peak, average, and/or idle mode power consumption. In this way, the mobile device may receive the connection request from the hygiene device. In another example, the connection request may be broadcast from the mobile device to the hygiene device.

At 106, a communication connection (e.g., a Bluetooth connection) may be established between the mobile device and the hygiene device based upon the connection request. For example, a two-way wireless communication connection may be established. At 108, a user zone entry notification may be received from the hygiene device. The user zone entry notification may indicate that the mobile device is located within a hygiene zone associated with the hygiene device (e.g., the doctor may walk into a hygiene zone defined as at least a portion of the patient room). In an example, a hygiene compliance opportunity alert may be provided, such as through the personalized hygiene compliance tracking interface, based upon the user zone entry notification. For example, a visual notification may be displayed through the mobile device (e.g., a visual indicator of the hygiene device may be displayed with a message that the user can comply with a hygiene opportunity by utilizing the hygiene device), an audio notification may be provided through the mobile device, a vibration notification may be provided through the mobile device, etc. A zone entry metric may be generated for the user based upon the user zone entry notification. The zone entry metric may indicate that the user has an opportunity to comply with a hygiene opportunity by utilizing the hygiene device.

At 110, responsive to receiving a dispense notification from the hygiene device (e.g., an indication that the user complied with the hygiene opportunity by utilizing the hygiene device), a hygiene compliance metric may be generated for the user. The hygiene compliance metric may indicate that the user complied with the hygiene opportunity. At 112, responsive to not receiving a dispense notification before at least one of an expiration of a threshold time (e.g., the doctor may be provided with a 10 minute limit within which to use the hygiene device after entering the hygiene zone) or receiving a user zone exit notification (e.g., the doctor leaves the hygiene zone without utilizing the hygiene dispenser), a hygiene non-compliance metric may be generated for the user. The hygiene non-compliance metric may indicate that the user failed to comply with the hygiene opportunity. In this way, the user may personally track hygiene compliance through the mobile device (e.g., real-time tracking through the personalized hygiene compliance tracking interface) based upon automated information communicated between the mobile device and hygiene devices. In an example, the hygiene compliance metric, the hygiene non-compliance metric, a hygiene compliance ratio (e.g., a ratio of hygiene compliance to hygiene non-compliance), and/or a variety of other information (e.g., a map populated with one or more hygiene device indicators that may indicate prior compliance and/or non-compliance associated with corresponding hygiene devices) may be displayed through the personalized hygiene compliance tracking interface. In an example, the hygiene compliance metric and/or the hygiene non-compliance metric may be provided to a second user (e.g., a hygiene compliance manager for a hospital).

In an example, the hygiene compliance metric and/or the hygiene non-compliance metric may be sent to a centralized processing device for community hygiene compliance aggregation (e.g., aggregate with hygiene compliance information associated with other employees of the hospital). An aggregated community hygiene compliance metric may be received from the centralized process device. The aggregated community hygiene compliance metric may indicate how the user compares with other users with respect to hygiene compliance. The aggregated community hygiene compliance metric may be displayed through the personalized hygiene compliance tracking interface.

In an example, the mobile device may utilize the communication connection to program and/or reprogram the hygiene device. For example, a programming instruction may be sent to the hygiene device. The programming instruction may specify a location of the hygiene device, a hygiene zone definition of a hygiene zone for the hygiene device, and/or a variety of other information (e.g., a new communication protocol to utilize; a firmware update; a new amount of material to dispense; how to communicate an alert of an operational issue of the hygiene device such as a low battery issue or an empty refill container issue; etc.). In this way, hygiene devices may be wirelessly programmed from the mobile device. At 114, the method ends.

Figure 2A:
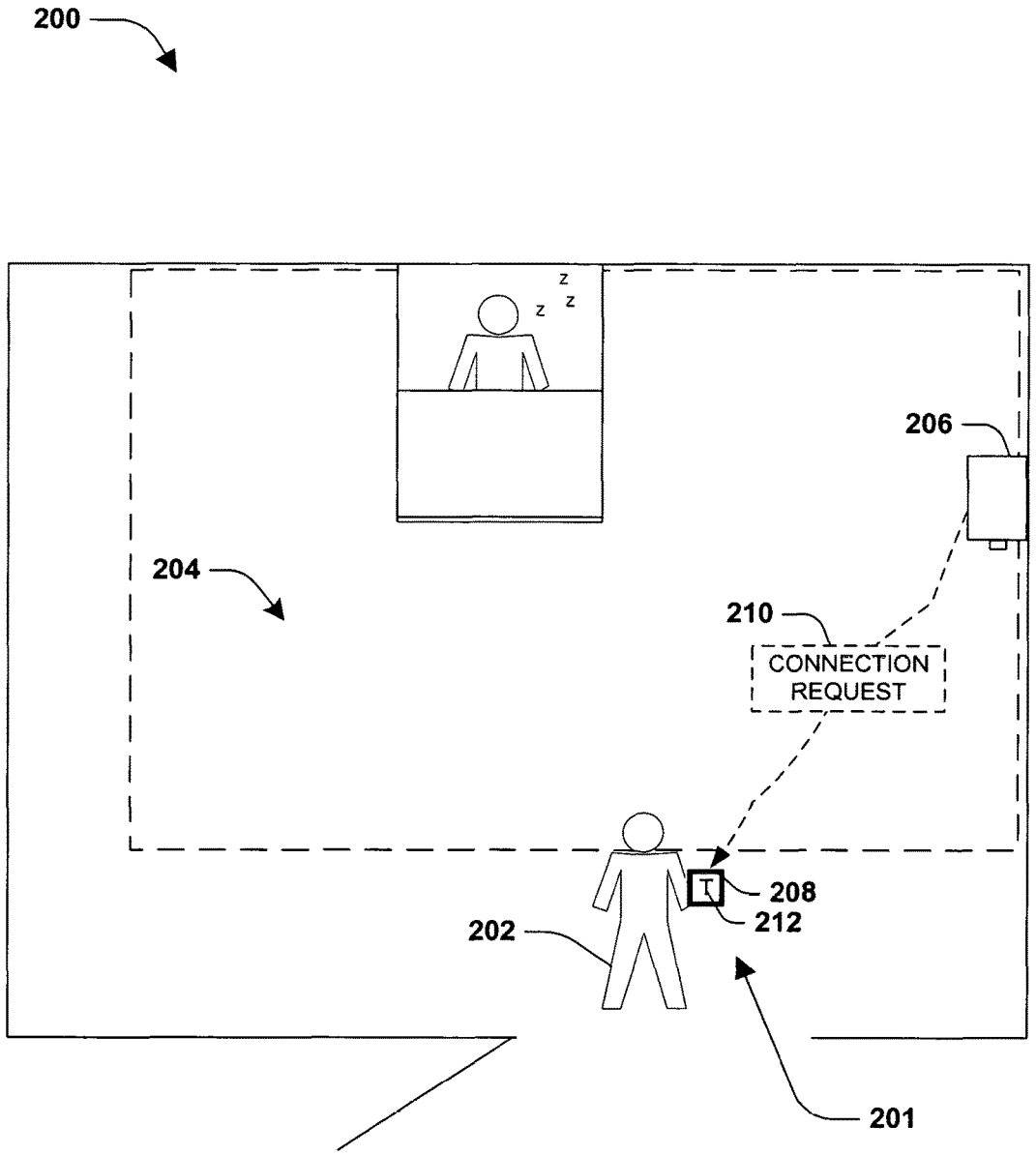
FIG. 2A is an illustration of an example of receiving a connection request from a hygiene device.

FIGS. 2A-2F illustrate examples of a system 201 for tracking hygiene compliance. FIG. 2A illustrates an example 200 of receiving a connection request 210 from a hygiene device 206. In an example, a user may carry a mobile device 208 (e.g., a tablet, a cell phone, etc.). The mobile device 208 may comprise a tracking component 212 (e.g., a hygiene tracking app). The tracking component 212 may be configured to receive the connection request 210 from the hygiene device 206. In an example, the tracking component 212 may be associated with a wireless communication module of the mobile device 208, such as a Bluetooth module. The tracking component 212 may receive one or more connectable advertising packets comprising at least a portion of the connection request 210 (e.g., connectable advertising packets, such as adverts, broadcast over one or more channels, such as 3 channels, by a Bluetooth module of the hygiene device 206).

Figure 2B:
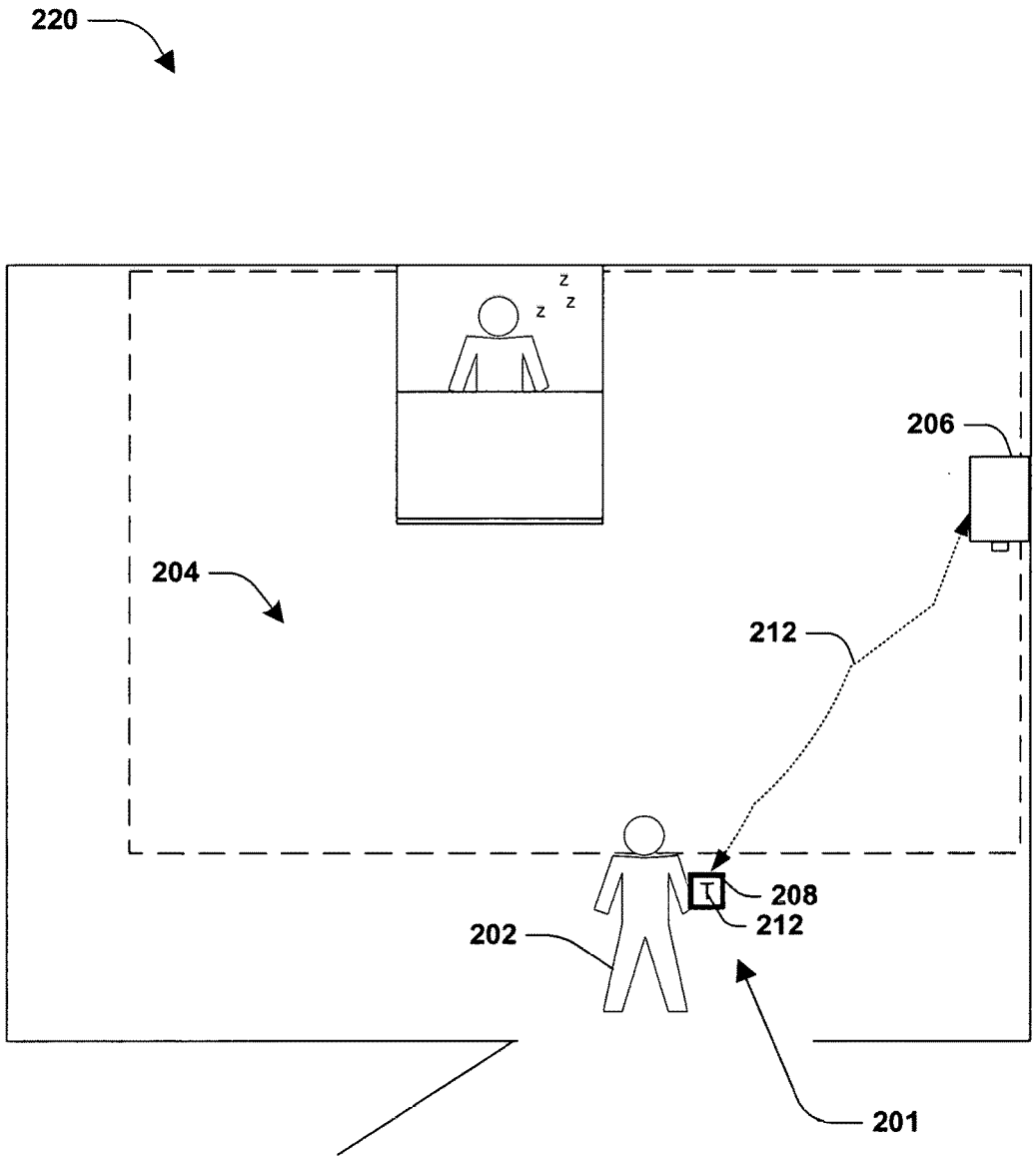
FIG. 2B is an illustration of an example of establishing a communication connection between a mobile device and a hygiene device.

FIG. 2B illustrates an example 220 of establishing a communication connection 212 between the mobile device 208 and the hygiene device 206 based upon the connection request 210. For example, the tracking component 212 (e.g., the hygiene tracking app hosted on the mobile device 208) may be configured to synchronize with the hygiene device 206, such as using a Bluetooth communication protocol, so that the mobile device 208 may receive automated hygiene compliance information from the hygiene device 206 for personal tracking of hygiene compliance by the user 202.

Figure 2C:
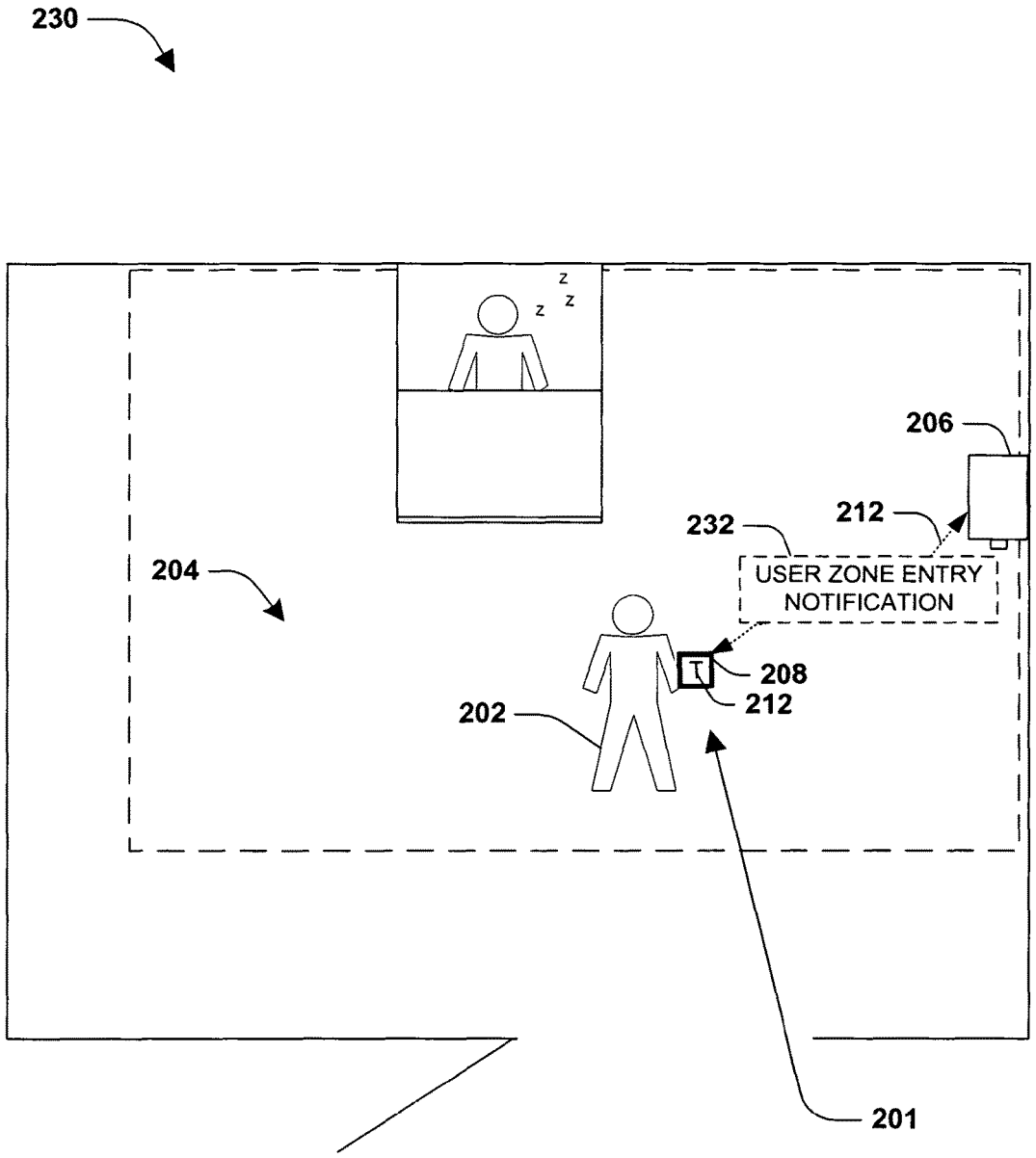
FIG. 2C is an illustration of an example of receiving a user zone entry notification from a hygiene device.

FIG. 2C illustrates an example 230 of receiving a user zone entry notification 232 from the hygiene device 206 over the communication connection 212. For example, a hygiene zone 204 may be defined for the hygiene device 206 as an area within a patient room. The hygiene device 206 may determine that the user 202, such as the mobile device 208, entered into the hygiene zone 204 (e.g., based upon location information provided by the mobile device 208 to the hygiene device 206; based upon detection by a passive sensor, an active sensor, or any other detection sensor of the hygiene device 206; etc.). Accordingly, the hygiene device 206 sends the user zone entry notification 232 over the communication connection 212 to the tracking component 212 on the mobile device 208. The tracking component 212 may create a zone entry metric for the user 202 based upon the user zone entry notification 232. The zone entry metric may be used to track locational information and/or hygiene compliance opportunities of the user 202 (e.g., the zone entry metric may indicate that the user has an opportunity to comply with a hygiene opportunity by utilizing the hygiene dispenser 206).

Figure 2D:
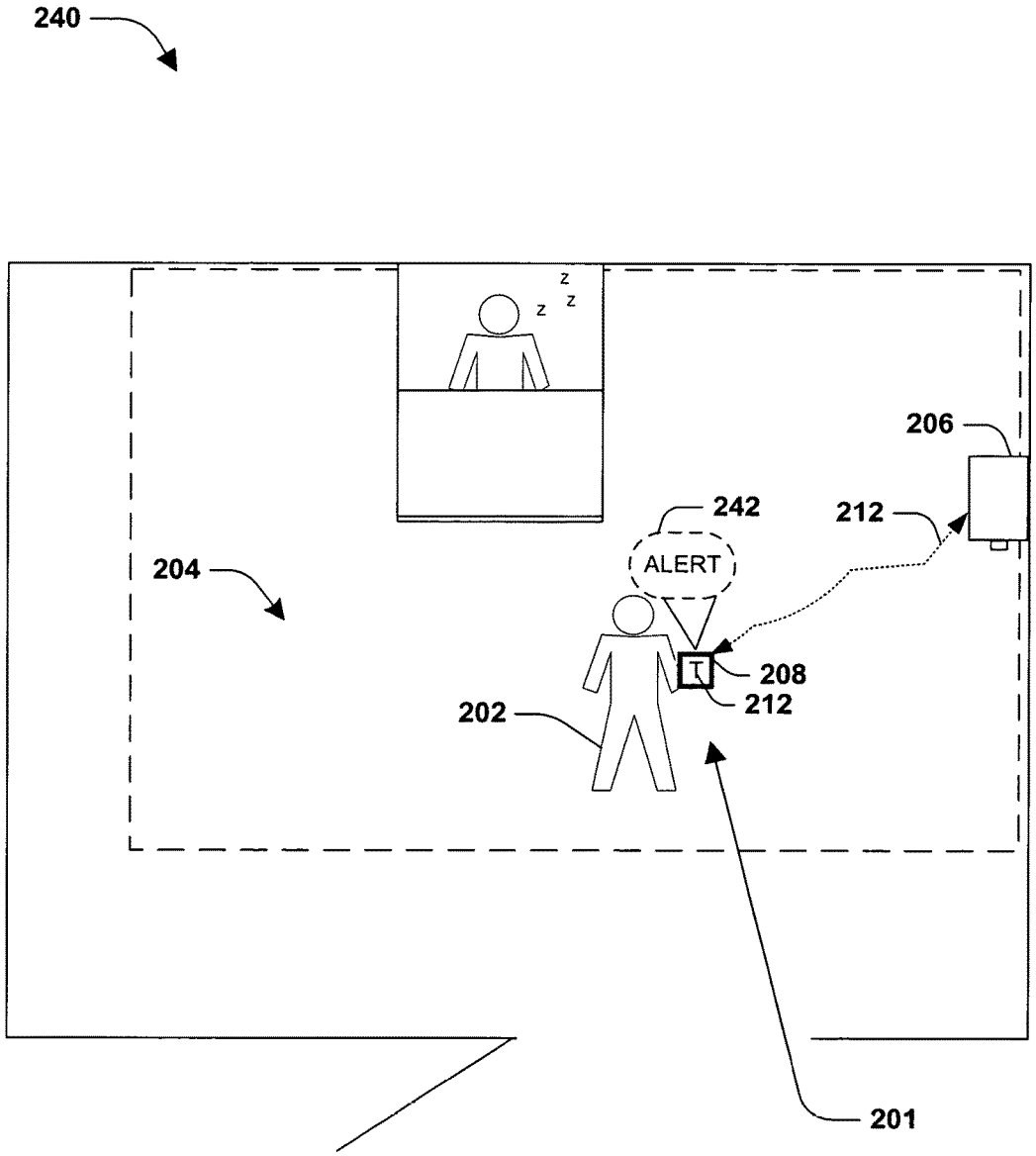
FIG. 2D is an illustration of an example of a tracking component providing a user with an alert through a mobile device.

FIG. 2D illustrates an example 240 of the tracking component 212 providing the user 202 with an alert 242 through the mobile device 208. In an example, the alert 242 may be provided as a visual notification though the mobile device 208, such as through the personalized hygiene compliance tracking interface (e.g., an interactive map, populated with a hygiene device indicator for the hygiene device 206, may be displayed). In another example, the alert 242 may be provided as an audio notification through the mobile device 208. In another example, the alert 242 may be provided as a vibration notification through the mobile device 208. In this way, the user 202 may become aware of a hygiene opportunity for the user 202 to use the hygiene device 206.

Figure 2E:
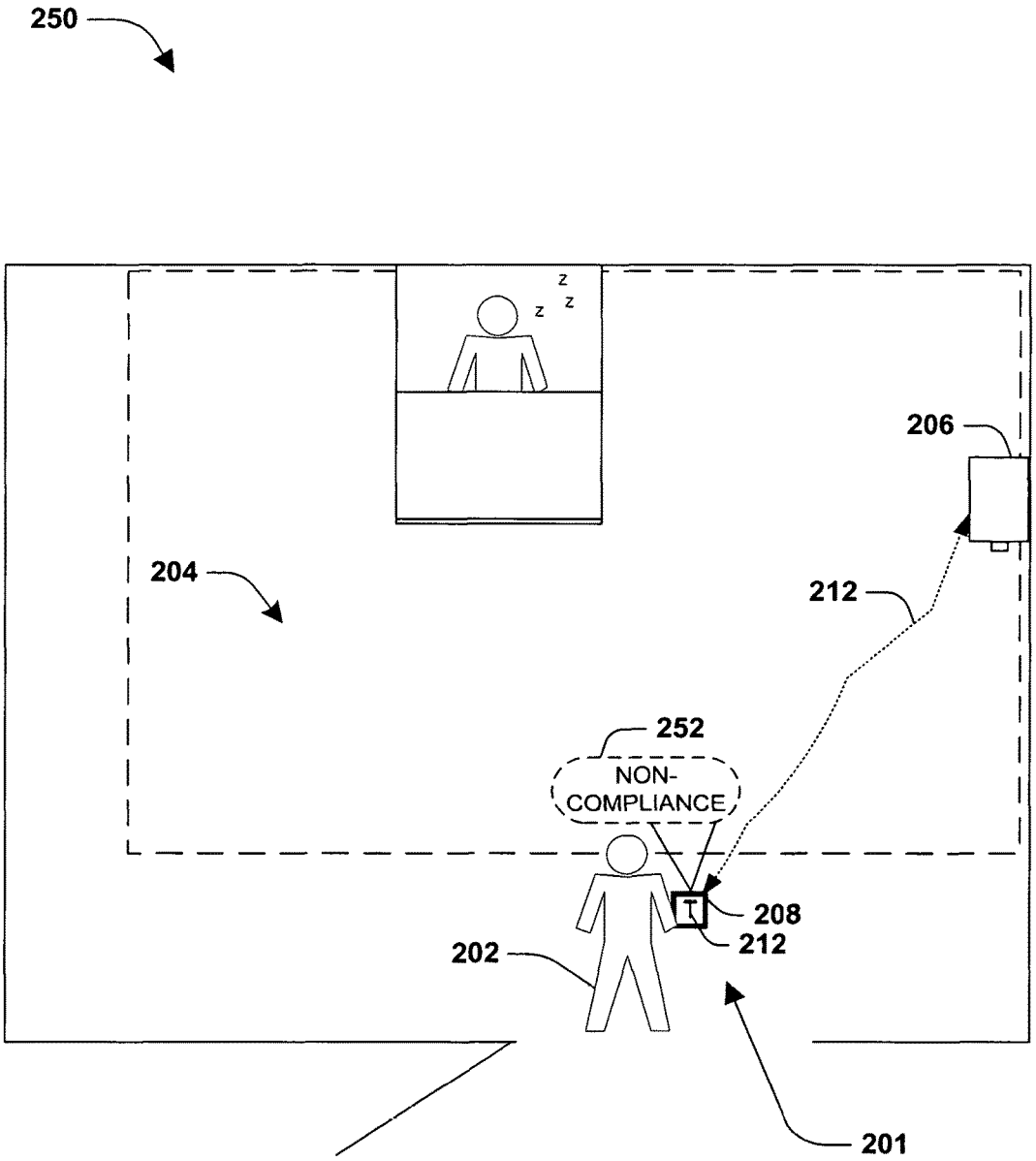
FIG. 2E is an illustration of an example of generating a non-compliance metric for a user.

FIG. 2E illustrates an example 250 of generating a hygiene non-compliance metric 252 for the user 202. The tracking component 212 may be configured to determine that the user 202 did not comply with the hygiene opportunity based upon a variety of criteria and/or information. In an example, the tracking component 212 may determine non-compliance based upon the tracking component 212 not receiving a dispense event notification (e.g., otherwise indicating compliance) before expiration of a threshold time (e.g., the user 202 may be given 10 minutes to comply with the hygiene opportunity, such as using the hygiene dispenser 206, after entering the hygiene zone 204). In another example, the tracking component 212 may determine non-compliance based upon the tracking component 212 receiving a user zone exit notification before receiving a dispense event notification (e.g., the hygiene dispenser 206 determines that the user 202 walked outside the hygiene zone 204, such as to leave the patient room, without utilizing the hygiene device 206). In an example, a challenge alert may be provided to the user 202. The challenge alert may indicate that the user has an opportunity to comply with the hygiene opportunity, which may be used to modify and/or remove the hygiene non-compliance metric 252 (e.g., the hygiene non-compliance metric 252 may be changed to a hygiene compliance metric based upon the user 202 using a hygiene device within a challenge threshold amount of time such as 2 minutes). In this way, hygiene information, such as the hygiene non-compliance metric 252, may be automatically generated for personal real-time tracking by the user 202 based upon automated hygiene information shared between the tracking component 212 and the hygiene device 206.

Figure 2F:
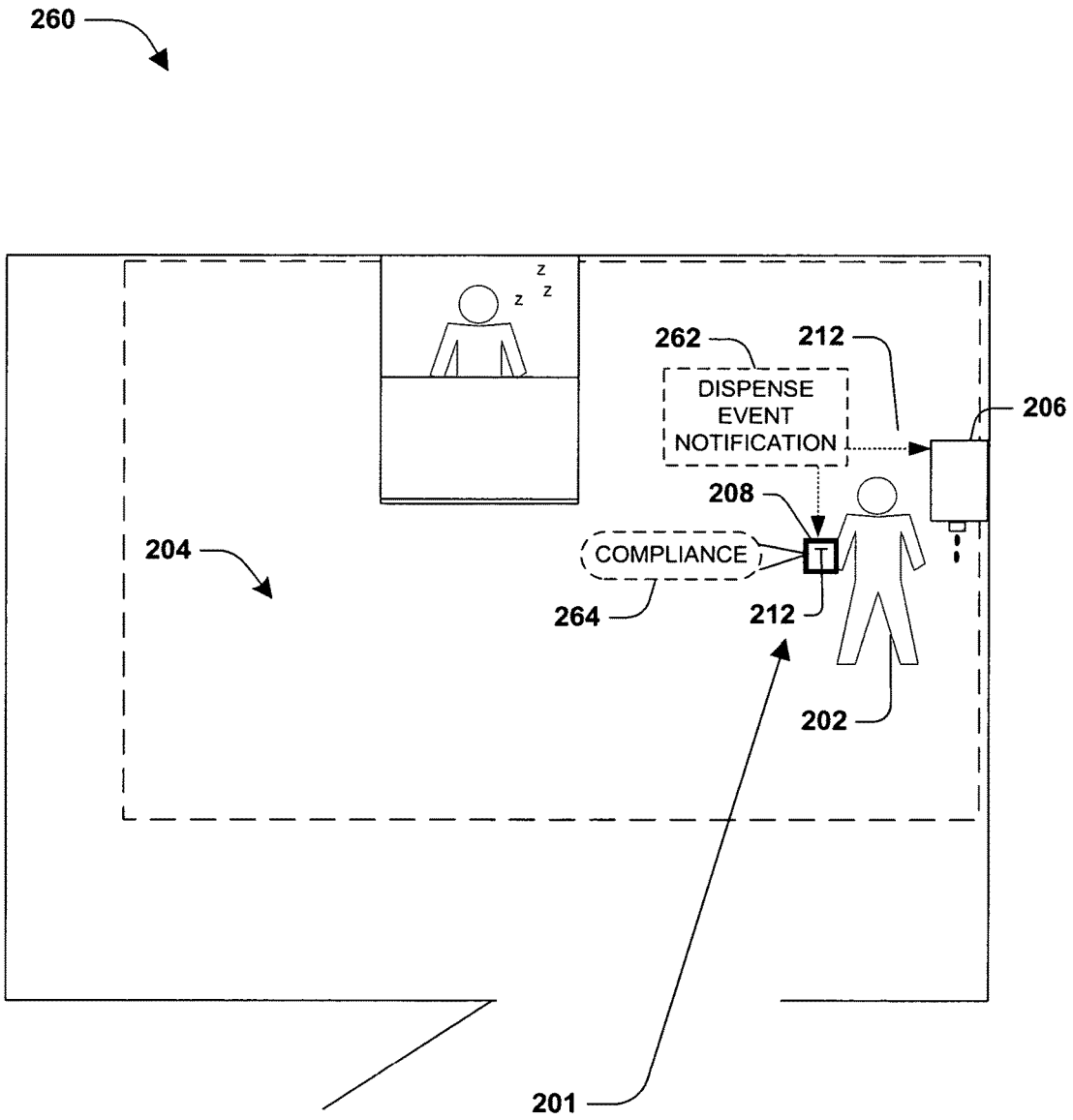
FIG. 2F is an illustration of an example of generating a compliance metric for a user.

FIG. 2F illustrates an example 260 of generating a hygiene compliance metric 264 for the user 202. The hygiene device 206 may be configured to identify utilization of the hygiene device 206 by the user 202 (e.g., the user 202 may dispense a material such as an antibacterial material from the hygiene device 206). The hygiene device 206 may broadcast a dispense event notification 262 (e.g., a Bluetooth message) based upon the utilization of the hygiene device 206. The tracking component 212 may be configured to receive the dispense event notification 262 from the hygiene dispenser 206. The tracking component 212 may generate the hygiene compliance metric 264 based upon the dispense event notification 262 (e.g., the user 202 may be credited for complying with the hygiene opportunity). In this way, hygiene information, such as the hygiene compliance metric 264, may be automatically generated for personal real-time tracking by the user 202 based upon automated hygiene information shared between the tracking component 212 and the hygiene device 206.

Figure 3:
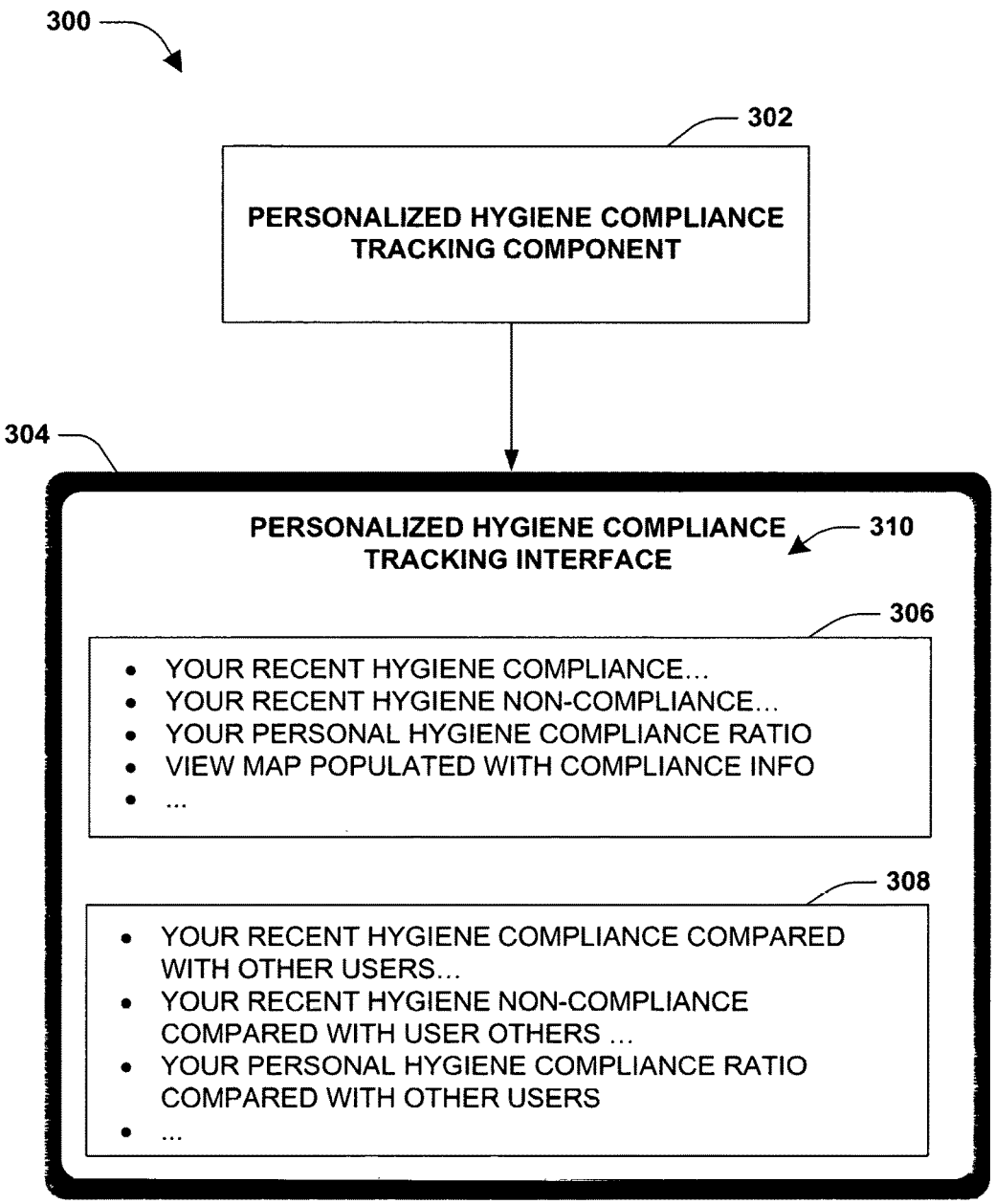
FIG. 3 is an illustration of an example of providing a personalized hygiene compliance tracking interface through a mobile device associated with a user.

FIG. 3 illustrates an example 300 of providing a personalized hygiene compliance tracking interface 310 through a mobile device 304 associated with a user. A personalized hygiene compliance tracking component 302 may be configured to evaluate hygiene compliance metrics, hygiene non-compliance metrics, and/or other hygiene information associated with the user to create personalized hygiene tracking information 306 through which the user may personally track hygiene compliance information such as hygiene compliance, hygiene non-compliance, a personal hygiene compliance ratio, a map populated with compliance information (e.g., indicators of where the user complied or failed to comply with hygiene opportunities), and/or a variety of other information. The personalized hygiene compliance tracking component 302 may display the personalized hygiene tracking information 306 through a personalized hygiene compliance tracking interface 310 hosted on the mobile device 304.

In an example, the personalized hygiene compliance tracking component 302 may receive aggregated community hygiene compliance metrics 308 associated with a community of users. For example, the aggregated community hygiene compliance metrics 308 may provide an evaluation of how the user compares with the community of users, such as a comparison of hygiene compliance of the user with hygiene compliance of other users. The personalized hygiene compliance tracking component 302 may display the aggregated community hygiene compliance metrics 308 through the personalized hygiene compliance tracking interface 310. In this way, the user may track hygiene information associated with the user and/or other users in real-time using the personalized hygiene compliance tracking interface 310.

Figure 4A:
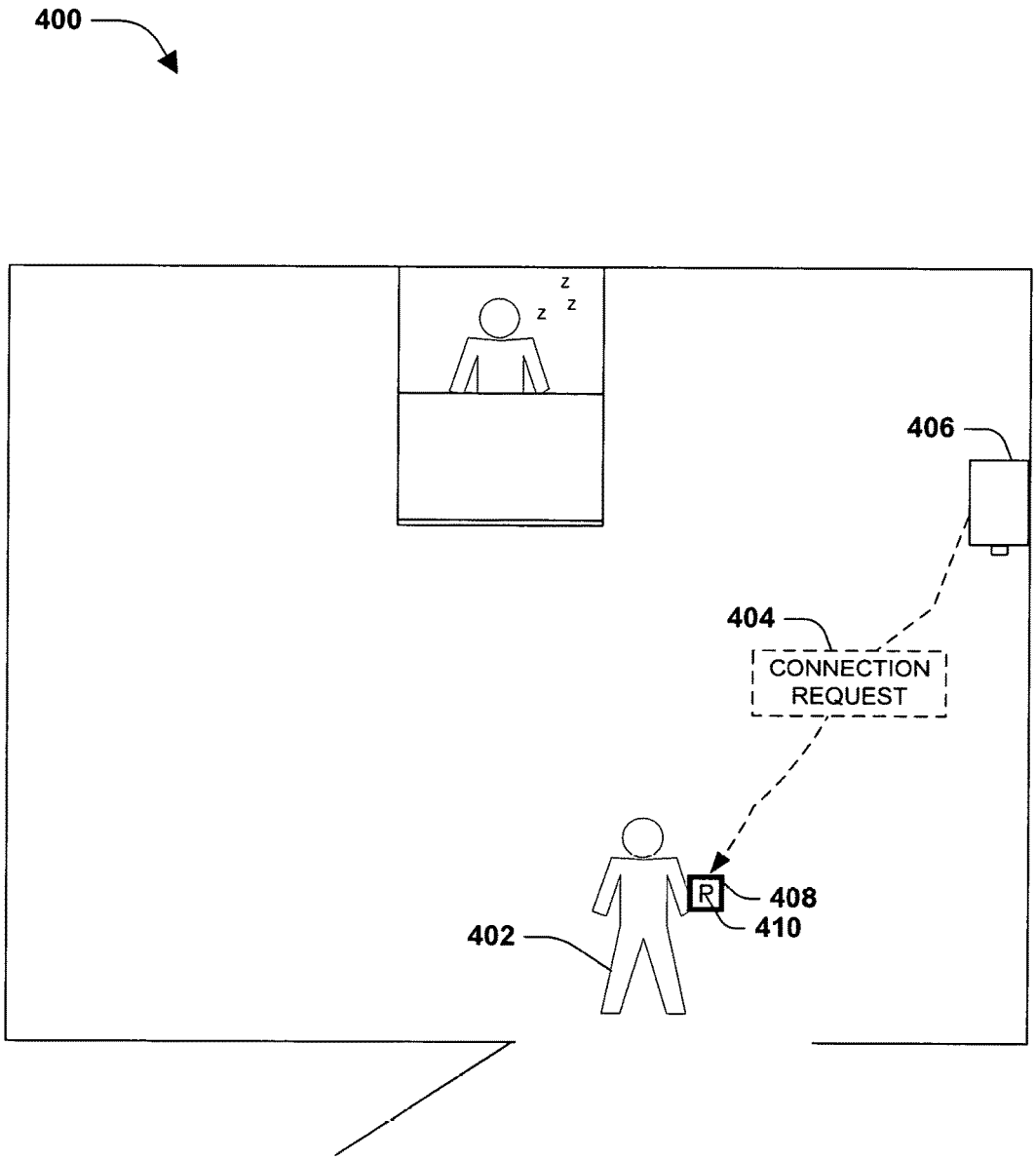
FIG. 4A is an illustration of an example of receiving a connection request from a hygiene device.
Figure 4B:
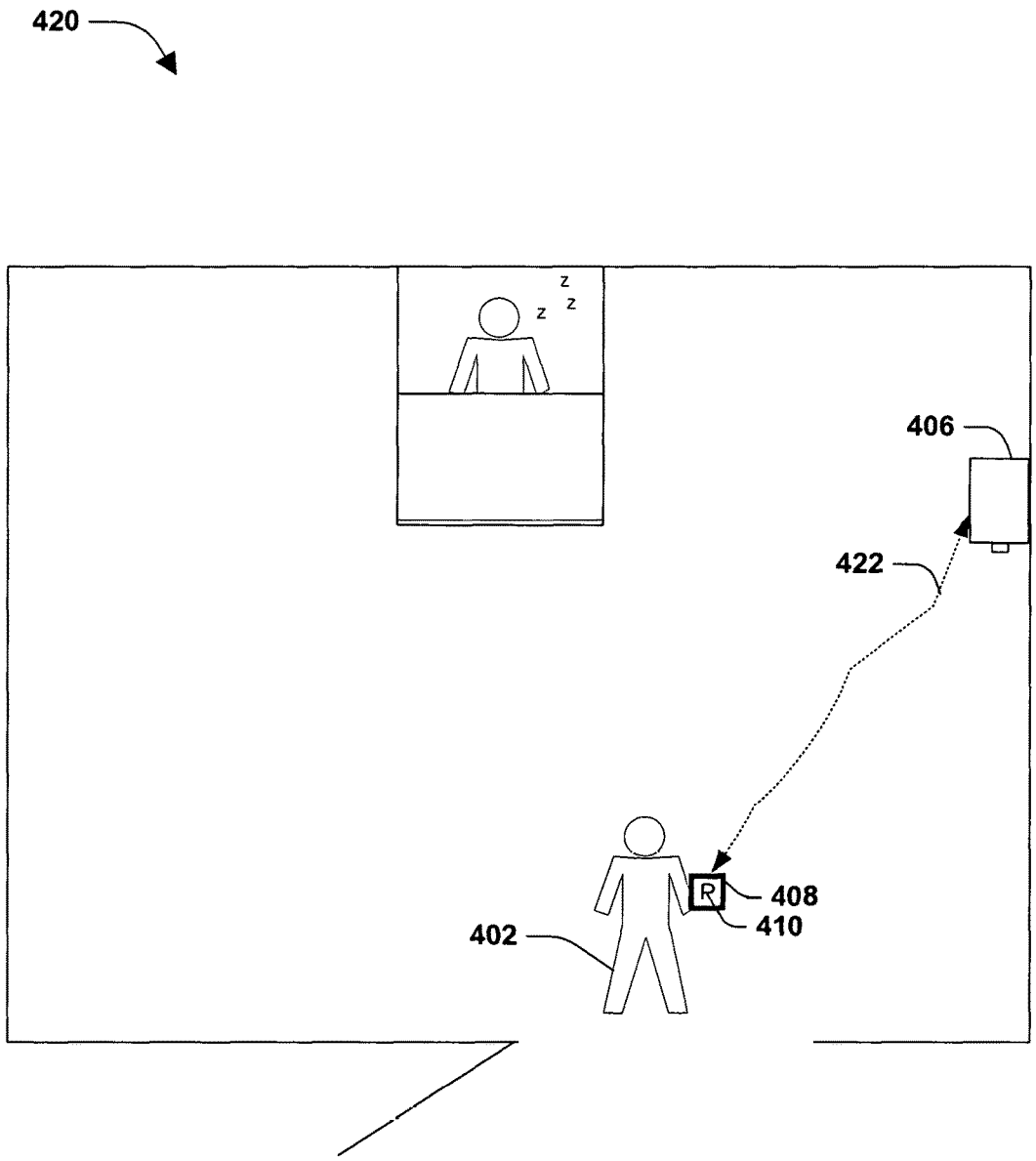
FIG. 4B is an illustration of an example of establishing a communication connection between a mobile device and a hygiene device.
Figure 4C:
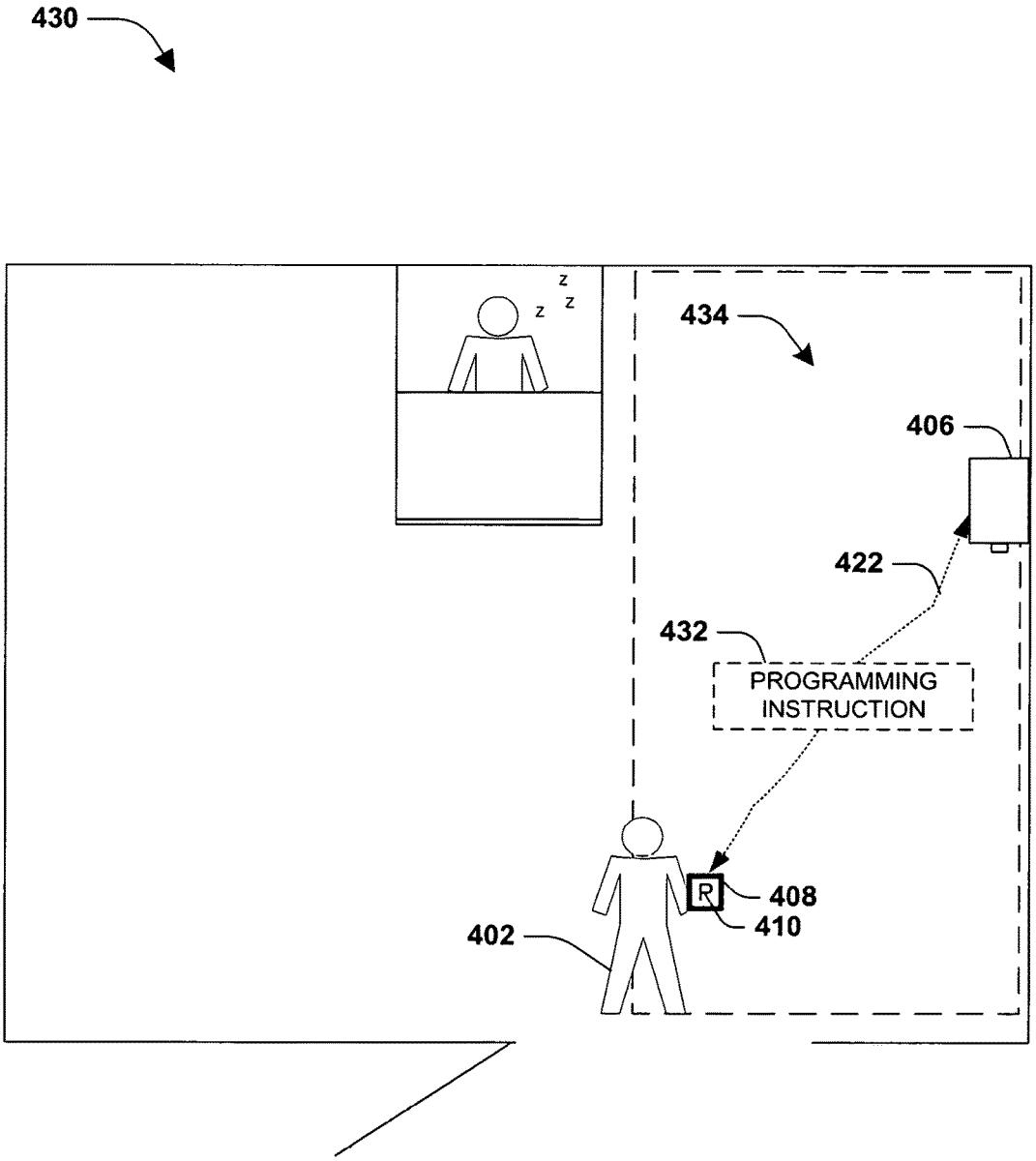
FIG. 4C is an illustration of an example of programming a hygiene device.

FIGS. 4A-4C illustrate examples of programming a hygiene device 406 utilizing a mobile device 408 associated with a user 402. FIG. 4A illustrates an example 400 of the mobile device 408 receiving a connection request 404 from a hygiene device 406. In an example, the connection request 404 may be broadcast by the hygiene device 406 utilizing a Bluetooth protocol. In another example, the connection request 404 may be broadcast from the mobile device 408 to the hygiene device 406. FIG. 4B illustrates an example 420 of the mobile device 408 and the hygiene device 406 establishing a communication connection 422 (e.g., a Bluetooth communication connection) based upon the connection request 404.

FIG. 4C illustrates an example 430 of a programming component 410, hosted on the mobile device 408, sending a programming instruction 432 to the hygiene device 406 over the communication connection 422. In an example, the programming instruction 432 may specify a hygiene zone definition of a hygiene zone 434 that may be used by the hygiene device 406 to determine that a hygiene opportunity exits for a user that enters the hygiene zone 434. It may be appreciated that the programming instruction 432 may provide a variety of instructions to the hygiene device 406 (e.g., a dispense amount change; a zone type change such as a change from a patient room zone having a first set of hygiene compliance rules to a hallway zone having a second set of hygiene compliance rules; a power setting corresponding to a hygiene zone range; etc.). In this way, the user 402 may program the hygiene device 406 over the communication connection 422 such as the Bluetooth communication connection.

Figure 5:
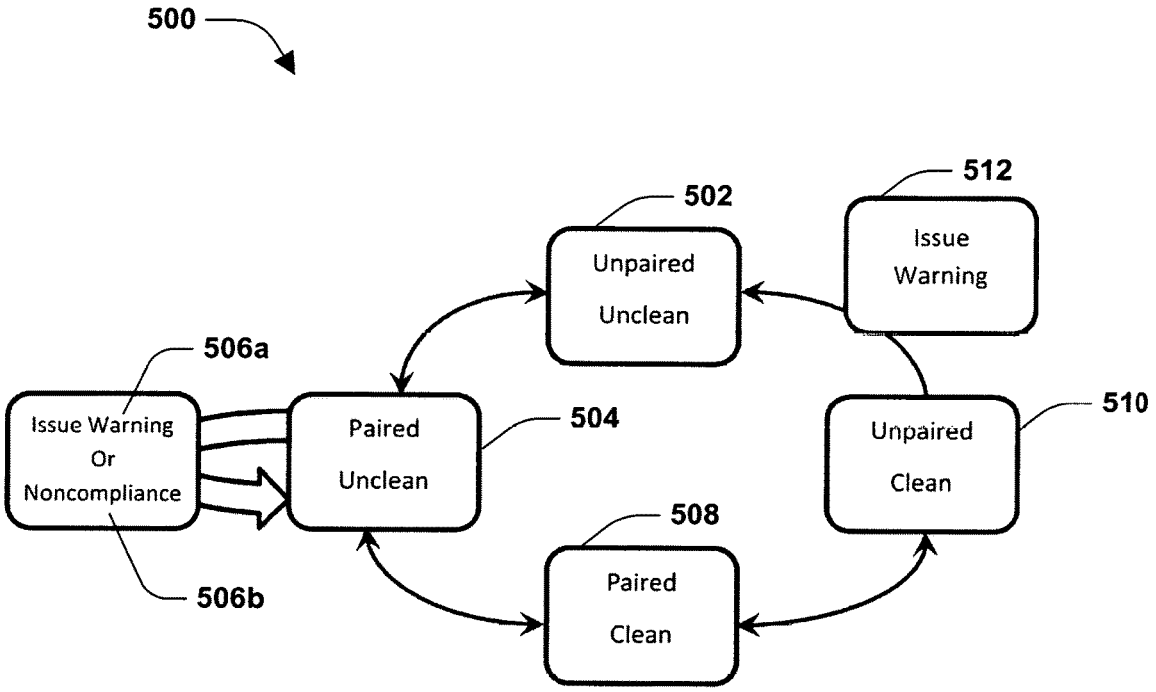
FIG. 5 is a flow diagram illustrating an exemplary method of tracking hygiene compliance of a user.

An embodiment of tracking hygiene compliance of a user is illustrated by an exemplary method 500 of FIG. 5. In an example, a mobile device, such as a smart phone, associated with a user may host a hygiene app. The hygiene app may determine that the mobile device and user are in an unpaired/unclean state 502 where the mobile device is not paired with a hygiene device (e.g., not paired with a Bluetooth module of a hygiene dispenser) and the user is considered unclean.

When the mobile device enters a hygiene zone associated with a hygiene device, then the hygiene app may determine that the mobile device and the user are in a paired/unclean state 504. A timer may be started based upon the paired/unclean state 504. If the timer reaches a first predetermined set-point, then a warning 506*a* is triggered for the user (e.g., the user may be alerted that the user may be determined as being non-compliant with a hygiene opportunity to use the hygiene dispenser if the user does not use the hygiene dispenser within a set amount of time). If the timer reaches a second predetermined set-point, then a non-compliance event 506*b* is recorded as a hygiene non-compliance metric. If the mobile device leaves the hygiene zone, then the hygiene app may determine that the mobile device and the user are in the unpaired/unclean state 502. If the mobile device receives a dispense event notification from the hygiene dispenser, then the hygiene app may determine that the mobile device and the user are in the paired/clean state 508. A second timer may be started based upon the paired/clean state 508. If the second timer reaches a third predetermined set-point, then the hygiene app may determine that the mobile device and the user are in the paired/unclean state 504. If the mobile device leaves the hygiene zone (e.g., and the second timer has not yet reached the third predetermined set-point), then the hygiene app may determine that the mobile device and the user are in an unpaired/clean state 510. If the mobile device receives a second dispense event notification from the hygiene dispenser, then the second timer is reset.

While in the unpaired/clean state 510, the second timer is maintained. If the second timer reaches a predetermined set-point, a warning 512 is triggered for the user and/or the hygiene app determines that the mobile device and the user are in the unpaired/unclean state 502. When the mobile device enters the hygiene zone, then the hygiene app determines that the mobile device and the user are in the paired/clean state 508 without resetting the second timer. In this way, the hygiene app may transition between various states for person hygiene compliance tracking by the user based upon locational rules and/or temporal rules. Hosting the hygiene app on a mobile device (e.g., an existing smartphone owned by the user, which may comprise Bluetooth functionality capable of detecting and/or communicating with a Bluetooth module embedded in a hygiene dispenser) may mitigate the need for specialized equipment (e.g., badges) and/or dedicates network equipment (e.g., repeaters, gateways, etc.). The hygiene app may be used for hygiene compliance in hospitals, long term care facilities, home-based care, doctors' offices, rehab facilities, and/or a wide variety of other environments.

Figure 6:
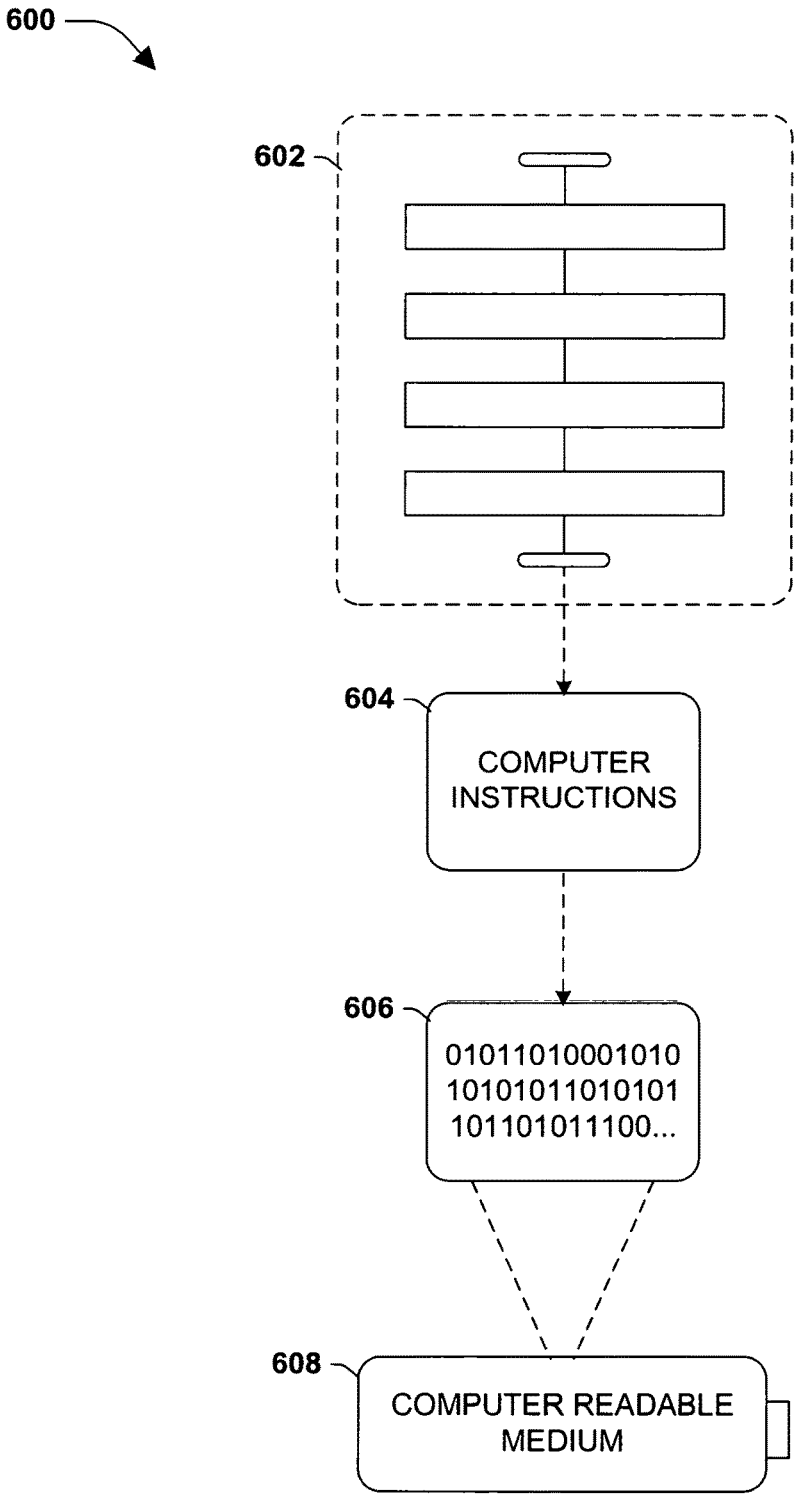
FIG. 6 is an illustration of an exemplary computer readable medium wherein processor-executable instructions configured to embody one or more of the provisions set forth herein may be comprised.

Still another embodiment involves a computer-readable medium comprising processor-executable instructions configured to implement one or more of the techniques presented herein. An example embodiment of a computer-readable medium or a computer-readable device is illustrated in FIG. 6, wherein the implementation 600 comprises a computer-readable medium 608, such as a CD-R, DVD-R, flash drive, a platter of a hard disk drive, etc., on which is encoded computer-readable data 606. This computer-readable data 606, such as binary data comprising at least one of a zero or a one, in turn comprises a set of computer instructions 604 configured to operate according to one or more of the principles set forth herein. In some embodiments, the processor-executable computer instructions 604 are configured to perform a method 602, such as at least some of the exemplary method 100 of FIG. 1, for example. In some embodiments, the processor-executable instructions 604 are configured to implement a system, such as at least some of the exemplary system 201 of FIGS. 2A-2F, for example. Many such computer-readable media are devised by those of ordinary skill in the art that are configured to operate in accordance with the techniques presented herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing at least some of the claims.

As used in this application, the terms "component," "module," "system", "interface", and/or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, many modifications may be made to this configuration without departing from the scope or spirit of the claimed subject matter.

Figure 7:
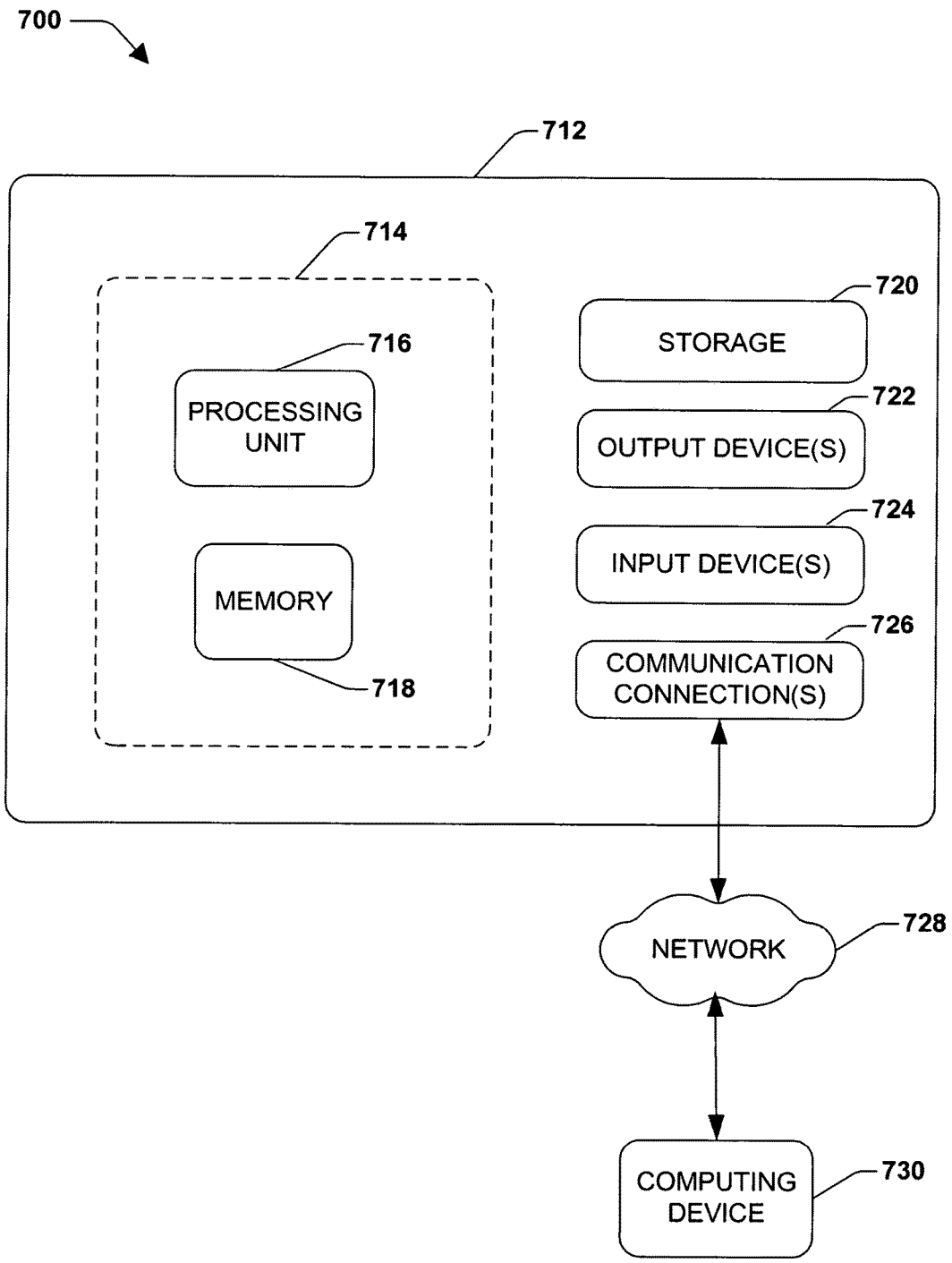
FIG. 7 illustrates an exemplary computing environment wherein one or more of the provisions set forth herein may be implemented.

FIG. 7 and the following discussion provide a brief, general description of a suitable computing environment to implement embodiments of one or more of the provisions set forth herein. The operating environment of FIG. 7 is only one example of a suitable operating environment and is not intended to suggest any limitation as to the scope of use or functionality of the operating environment. Example computing devices include, but are not limited to, personal computers, server computers, hand-held or laptop devices, mobile devices (such as mobile phones, Personal Digital Assistants (PDAs), media players, and the like), multiprocessor systems, consumer electronics, mini computers, mainframe computers, distributed computing environments that include any of the above systems or devices, and the like.

Although not required, embodiments are described in the general context of "computer readable instructions" being executed by one or more computing devices. Computer readable instructions may be distributed via computer readable media (discussed below). Computer readable instructions may be implemented as program modules, such as functions, objects, Application Programming Interfaces (APIs), data structures, and the like, that perform particular tasks or implement particular abstract data types. Typically, the functionality of the computer readable instructions may be combined or distributed as desired in various environments.

FIG. 7 illustrates an example of a system 700 comprising a computing device 712 configured to implement one or more embodiments provided herein. In one configuration, computing device 712 includes at least one processing unit 716 and memory 718. Depending on the exact configuration and type of computing device, memory 718 may be volatile (such as RAM, for example), non-volatile (such as ROM, flash memory, etc., for example) or some combination of the two. This configuration is illustrated in FIG. 7 by dashed line 714.

In other embodiments, device 712 may include additional features and/or functionality. For example, device 712 may also include additional storage (e.g., removable and/or non-removable) including, but not limited to, magnetic storage, optical storage, and the like. Such additional storage is illustrated in FIG. 7 by storage 720. In one embodiment, computer readable instructions to implement one or more embodiments provided herein may be in storage 720. Storage 720 may also store other computer readable instructions to implement an operating system, an application program, and the like. Computer readable instructions may be loaded in memory 718 for execution by processing unit 716, for example.

The term "computer readable media" as used herein includes computer storage media. Computer storage media includes volatile and nonvolatile, removable and non-removable media implemented in any method or technology for storage of information such as computer readable instructions or other data. Memory 718 and storage 720 are examples of computer storage media. Computer storage media includes, but is not limited to, RAM, ROM, EEPROM, flash memory or other memory technology, CD-ROM, Digital Versatile Disks (DVDs) or other optical storage, magnetic cassettes, magnetic tape, magnetic disk storage or other magnetic storage devices, or any other medium which can be used to store the desired information and which can be accessed by device 712. Any such computer storage media may be part of device 712.

Device 712 may also include communication connection(s) 726 that allows device 712 to communicate with other devices. Communication connection(s) 726 may include, but is not limited to, a modem, a Network Interface Card (NIC), an integrated network interface, a radio frequency transmitter/receiver, an infrared port, a USB connection, or other interfaces for connecting computing device 712 to other computing devices. Communication connection(s) 726 may include a wired connection or a wireless connection. Communication connection(s) 726 may transmit and/or receive communication media.

The term "computer readable media" may include communication media. Communication media typically embodies computer readable instructions or other data in a "modulated data signal" such as a carrier wave or other transport mechanism and includes any information delivery media. The term "modulated data signal" may include a signal that has one or more of its characteristics set or changed in such a manner as to encode information in the signal.

Device 712 may include input device(s) 724 such as keyboard, mouse, pen, voice input device, touch input device, infrared cameras, video input devices, and/or any other input device. Output device(s) 722 such as one or more displays, speakers, printers, and/or any other output device may also be included in device 712. Input device(s) 724 and output device(s) 722 may be connected to device 712 via a wired connection, wireless connection, or any combination thereof. In one embodiment, an input device or an output device from another computing device may be used as input device(s) 724 or output device(s) 722 for computing device 712.

Components of computing device 712 may be connected by various interconnects, such as a bus. Such interconnects may include a Peripheral Component Interconnect (PCI), such as PCI Express, a Universal Serial Bus (USB), firewire (IEEE 1394), an optical bus structure, and the like. In another embodiment, components of computing device 712 may be interconnected by a network. For example, memory 718 may be comprised of multiple physical memory units located in different physical locations interconnected by a network.

Those skilled in the art will realize that storage devices utilized to store computer readable instructions may be distributed across a network. For example, a computing device 730 accessible via a network 728 may store computer readable instructions to implement one or more embodiments provided herein. Computing device 712 may access computing device 730 and download a part or all of the computer readable instructions for execution. Alternatively, computing device 712 may download pieces of the computer readable instructions, as needed, or some instructions may be executed at computing device 712 and some at computing device 730.

Various operations of embodiments are provided herein. In one embodiment, one or more of the operations described may constitute computer readable instructions stored on one or more computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in each embodiment provided herein. Also, it will be understood that not all operations are necessary in some embodiments.

Further, unless specified otherwise, "first," "second," and/or the like are not intended to imply a temporal aspect, a spatial aspect, an ordering, etc. Rather, such terms are merely used as identifiers, names, etc. for features, elements, items, etc. For example, a first object and a second object generally correspond to object A and object B or two different or two identical objects or the same object.

Moreover, "exemplary" is used herein to mean serving as an example, instance, illustration, etc., and not necessarily as advantageous. As used herein, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B and/or the like generally means A or B or both A and B. Furthermore, to the extent that "includes", "having", "has", "with", and/or variants thereof are used in either the detailed description or the claims, such terms are intended to be inclusive in a manner similar to the term "comprising".

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A method for tracking hygiene compliance of a user, comprising:

receiving a connection request from a hygiene device;

establishing a communication connection between a mobile device and the hygiene device based upon the connection request;

receiving a user zone entry notification from the hygiene device, the user zone entry notification indicating that the mobile device is within a hygiene zone associated with the hygiene device;

displaying an alert, generated based upon the user zone entry notification, through a personalized hygiene compliance tracking interface hosted by the mobile device;

responsive to receiving a dispense event notification from the hygiene device, sending a hygiene compliance metric to a centralized processing device for community hygiene compliance aggregation;

receiving an aggregated community hygiene compliance metric from the centralized processing device; and displaying the aggregated community hygiene compliance metric through the mobile device.

2. The method of claim 1, comprising:

providing an audio notification of the alert through the mobile device.

3. The method of claim 1, comprising:

providing a vibration notification of the alert through the mobile device.

4. The method of claim 1, the receiving a user zone entry notification comprising:

generating a zone entry metric for the user.

5. The method of claim 1, comprising:

displaying a map through the mobile device, the map populated with one or more hygiene device indicators.

6. The method of claim 1, the receiving a connection request comprising:

receiving, by the mobile device, a wireless signal from the hygiene device, the wireless signal comprising the connection request.

7. The method of claim 1, the communication connection comprising a 2-way wireless communication connection.

8. The method of claim 1, comprising:

sending a programming instruction to the hygiene device over the communication connection.

9. The method of claim 8, the programming instruction specifying at least one of a location of the hygiene device or a hygiene zone definition of the hygiene zone.

10. The method of claim 1, comprising:

responsive to not receiving the dispense event notification before at least one of expiration of a threshold time or receiving a user zone exit notification, after receiving the user zone entry notification, generating a hygiene non-compliance metric for the user; and providing the hygiene non-compliance metric to a second user.

11. The method of claim 1, comprising:

responsive to receiving the dispense event notification from the hygiene device, after receiving the user zone entry notification, generating the hygiene compliance metric for the user; and providing the hygiene compliance metric to a second user.

12. A system for tracking hygiene compliance of a user, comprising:

a tracking component configured to:

receive a connection request from a hygiene device;

establish a communication connection between a mobile device and the hygiene device based upon the connection request;

populate a map with a hygiene device indicator, representing the hygiene device, at a location within the map that represents a physical location of the hygiene device; and display the map through a user interface of the mobile device.

13. The system of claim 12, comprising:

a personalized hygiene compliance tracking component configured to:

responsive to receiving a dispense event notification from the hygiene device, display a hygiene compliance metric through a personalized hygiene compliance tracking interface.

14. The system of claim 12, the tracking component configured to:

receive a user zone entry notification from the hygiene device, the user zone entry notification indicating that the mobile device is within a hygiene zone associated with the hygiene device; and provide a hygiene compliance opportunity alert based upon the user zone entry notification.

15. The system of claim 13, the personalized hygiene compliance tracking component configured to:

display an aggregated community hygiene compliance metric through the mobile device, the aggregated community hygiene compliance metric corresponding to an aggregate of the hygiene compliance metric with hygiene metrics of one or more community users.

16. The system of claim 12, the communication connection comprising a 2-way wireless communication connection.

17. The system of claim 12, comprising:

a programming component configured to:

send a programming instruction to the hygiene device over the communication connection.

18. A method for tracking hygiene compliance of a user, comprising:

receiving a connection request from a hygiene device;

establishing a communication connection between a mobile device and the hygiene device based upon the connection request;

populating a map with a hygiene device indicator, representing the hygiene device, at a location within the map that represents a physical location of the hygiene device; and displaying the map through a user interface of the mobile device.

19. The method of claim 18, comprising:

receiving a user zone entry notification from the hygiene device, the user zone entry notification indicating that the mobile device is within a hygiene zone associated with the hygiene device; and displaying an alert, generated based upon the user zone entry notification, through a personalized hygiene compliance tracking interface hosted by the mobile device.

20. The method of claim 18, comprising:

responsive to receiving a dispense event notification from the hygiene device, sending a hygiene compliance metric to a centralized processing device for community hygiene compliance aggregation;

receiving an aggregated community hygiene compliance metric from the centralized processing device; and displaying the aggregated community hygiene compliance metric through the mobile device.

* * * * *